US010280554B2

(12) United States Patent
Nam et al.

(10) Patent No.: US 10,280,554 B2
(45) Date of Patent: May 7, 2019

(54) DRYER

(71) Applicant: LG ELECTRONICS INC., Seoul (KR)

(72) Inventors: Hyunsu Nam, Seoul (KR); Haeyoon Je, Seoul (KR); Simong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 320 days.

(21) Appl. No.: 15/200,590

(22) Filed: Jul. 1, 2016

(65) Prior Publication Data

US 2017/0002509 A1 Jan. 5, 2017

(30) Foreign Application Priority Data

Jul. 2, 2015 (KR) ..... 10-2015-0094885
Jul. 2, 2015 (KR) ..... 10-2015-0094886

(51) Int. Cl.
*D06F 58/24* (2006.01)
*D06F 58/02* (2006.01)

(52) U.S. Cl.
CPC ..... *D06F 58/24* (2013.01); *D06F 58/02* (2013.01)

(58) Field of Classification Search
CPC ..... D06F 58/02; D06F 58/24
USPC ..... 34/139, 20
See application file for complete search history.

(56) References Cited

U.S. PATENT DOCUMENTS 2,742,708 A * 4/1956 McCormick ..... D06F 58/02 34/60
7,913,419 B2 * 3/2011 Tomasi ..... D06F 29/00 211/85.3
8,307,567 B2 * 11/2012 Han ..... D06F 31/00 34/132
8,707,581 B2 * 4/2014 Quaroni ..... D06F 39/12 34/604
8,793,893 B2 * 8/2014 Bae ..... D06F 58/203 34/192
8,931,186 B2 * 1/2015 Choi ..... D06F 58/04 34/427

(Continued)

FOREIGN PATENT DOCUMENTS

CN 202051249 U 11/2011
EP 0555703 A1 8/1993

(Continued)

*Primary Examiner* — Stephen M Gravini
(74) *Attorney, Agent, or Firm* — Dentons US LLP

(57) ABSTRACT

A dryer, including a cabinet with an entry hole, a door being installed in the entry hole, a drum disposed within the cabinet, an evaporator disposed within the cabinet to remove moisture from air circulating through the drum by condensing the moisture, a condensate housing disposed within the cabinet to collect condensate from the evaporator, a drawer space disposed under the entry hole, a drawer disposed in the drawer space to be rotated based on one side of the drawer and pulled out from the drawer space, a condensate discharge container to store the condensate moved from the condensate housing, the condensate discharge container being detachably held in the drawer, and exposed to a user when the drawer is pulled out, and a guide supporter to couple a cabinet-side structure and a drawer-side structure and to guide the rotation of the drawer with respect to the cabinet.

14 Claims, 10 Drawing Sheets

(56) References Cited

U.S. PATENT DOCUMENTS

| | | | | | |
|---|---|---|---|---|---|
| 9,611,578 | B2 * | 4/2017 | Underly | ..... | D06F 29/00 |
| 9,945,065 | B2 * | 4/2018 | Nam | ..... | D06F 58/24 |
| 2017/0002507 | A1 * | 1/2017 | Nam | ..... | D06F 58/24 |
| 2017/0002508 | A1 * | 1/2017 | Nam | ..... | D06F 58/02 |
| 2017/0002509 | A1 * | 1/2017 | Nam | ..... | D06F 58/02 |
| 2017/0051449 | A1 * | 2/2017 | Nam | ..... | D06F 58/24 |

FOREIGN PATENT DOCUMENTS

| | | | | | |
|---|---|---|---|---|---|
| EP | 1524359 | A1 | 4/2005 | | |
| EP | 1674607 | A1 | 6/2006 | | |
| EP | 2647754 | A1 | 10/2013 | | |
| EP | 2669420 | A1 | 12/2013 | | |
| EP | 3112529 | A1 * | 1/2017 | ..... | D06F 58/02 |
| KR | 10-0607276 | B1 | 7/2006 | | |
| KR | 10-0648173 | B1 | 11/2006 | | |
| KR | 10-2010-0082916 | A | 7/2010 | | |
| KR | 10-1305523 | B1 | 9/2013 | | |
| KR | 10-1435797 | B1 | 8/2014 | | |
| KR | 10-2014-0121003 | B1 | 10/2014 | | |
| WO | 2015074688 | A1 | 5/2015 | | |
| WO | 2015/101388 | A1 | 7/2015 | | |
| WO | WO 2017003254 | A1 * | 1/2017 | ..... | D06F 58/02 |

* cited by examiner

DRYER

CROSS-REFERENCE TO RELATED APPLICATION

Pursuant to 35 U.S.C. § 119(a), this application claims the benefit of earlier filing date and right of priority to Korean Patent Application No. 10-2015-0094885 and 10-2015-0094886, filed on Jul. 2, 2015, the contents of which are incorporated by reference herein in their entirety.

BACKGROUND

Field

The present disclosure relates to a condensation type dryer.

Discussion of the Related Art

In general, a laundry processing apparatus is an apparatus for processing the laundry by applying physical and chemical actions to the laundry, and collectively refers to a washer for removing contaminants on the laundry, a dehydrator for dehydrating the laundry by rotating a washing tub containing the laundry at high speed, and a dryer for drying wet laundry by applying cold air or hot air to a washing tub.

A laundry processing apparatus capable of drying clothing may be classified as an exhaust type drying system and a circulation type (or a condensation type) drying system based on the flowing method of air in supplying air (i.e., hot air) of a high temperature to clothing.

The circulation type drying system is configured to dehumidify moisture from air discharged by a tub, heat the air again, and supply the heated air to the inside of the tub again.

The exhaust type drying system is configured to supply heated air to the inside of the tub, but to discharge air discharged by the tub to the outside of a laundry processing apparatus without supplying the discharged air to the inside of the tub.

In a conventional condensation type drying system, a condensate discharge container for storing a condensate is inserted in the front and back direction of a cabinet. Furthermore, the conventional condensate discharge container is disposed over a drum so that a user can lift up the condensate discharge container easily.

However, there is a problem in that the space corresponding to the length of the condensate discharge container must be secured at the front of the washing machine due to the structure of the condensate discharge container that is disposed in a front to back direction.

Furthermore, there are problems in that the center of gravity of the drying system rises and the drying system becomes vulnerable to vibration when the condensate discharge container is filled with a condensate because the condensate discharge container is disposed over the drum.

Often, the dryer is stacked on the upper side of the drum washing machine.

If the dryer is stacked on the upper side of the drum washing machine as described above, there are problems in that the condensate discharge container placed over the drum is placed above the chest level of a user, which makes it difficult to draw the condensate discharge container out.

SUMMARY

One object of the present disclosure is to provide a dryer capable of minimizing a space required to draw a condensate discharge container out.

Another object of the present disclosure is to provide a dryer, which is capable of increasing the utilization of the space within a cabinet and increasing the capacity of a drum by disposing a condensate discharge container under the drum.

Yet another object of the present disclosure is to provide a dryer capable of further lowering the center of gravity when a condensate is stored.

Further yet, another object of the present disclosure is to provide a dryer which enables a user to draw the condensate discharge container out easily.

Another object of the present disclosure is to provide a dryer capable of uniformly distributing a load to the entire dryer by disposing the condensate discharge container at the front of the drum.

Still yet another object of the present disclosure is to provide a dryer, which is capable of minimizing a space attributable to the drawing of the condensate discharge container and reducing vibration because the center of gravity is lowered through a generated condensate by laterally disposing the condensate discharge container under the front of the drum.

Still yet another object of the present disclosure is to provide a dryer capable of drawing the condensate discharge container out easily although the dryer is stacked over the drum washing machine.

Technical objects to be achieved by the present invention are not limited to the aforementioned objects, and those skilled in the art may understand other technical objects from the following description.

A dryer according to one embodiment of the present invention includes a cabinet with an entry hole formed on the front surface of the cabinet, a door being installed in the entry hole, a drum disposed within the cabinet and configured to rotate with the laundry received within the drum, an evaporator disposed within the cabinet and configured to remove moisture from air circulating through the drum by condensing the moisture, a condensate housing disposed within the cabinet and configured to collect a condensate condensed by the evaporator, a drawer space disposed under the entry hole and depressed backward from the front surface of the cabinet, a drawer disposed in the drawer space and configured to be rotated based on one side of the drawer and pulled out from the drawer space, a condensate discharge container configured to store the condensate of the condensate housing, the condensate discharge container being detachably held in the drawer, and exposed to a user when the drawer is pulled out, and a guide supporter configured to couple a cabinet-side structure and a drawer-side structure and to guide the rotation of the drawer with respect to the cabinet.

When the drawer is pulled out, the drawer may be pulled out from the drawer space along with the condensate discharge container.

When the drawer is pulled out, the drawer may be pulled out from the drawer space and the condensate discharge container may remain in the drawer space.

The drawer may be installed in a horizontal direction in such a way as to be rotated around the cabinet. The guide supporter may include a pivot disposed on the one side of the drawer and configured to form a vertical rotating center of the drawer.

The guide supporter may further include a rotation guide disposed on the other side of the drawer and configured to guide the rotation of the drawer.

The rotation guide couples the drawer and the cabinet.

The rotation guide couples the drawer and the condensate housing.

The drawer may be installed up and down in such a way as to be rotated around the cabinet. The guide supporter may include pivots disposed on both sides of the drawer and configured to form a horizontal rotating center of the drawer.

The condensate discharge container may have a length longer in a left and right width direction than in a front and back direction.

The drawer may include a bucket configured to store a condensate overflowed from the condensate discharge container.

The drawer may be installed in a horizontal direction in such a way as to be rotated around the cabinet. The guide supporter may include a pivot disposed on one side of the bucket and configured to form a vertical rotation center of the drawer.

The guide supporter may further include a rotation guide disposed on the other side of the drawer and configured to guide the rotation of the drawer.

The drawer may be installed in a horizontal direction in such a way as to be rotated around the cabinet. The guide supporter may include pivots disposed on both sides of the bucket and configured to form a horizontal rotation center of the drawer.

The dryer may further include an overflow path disposed between the bucket and the condensate housing and configured to recover the condensate overflowed from the condensate discharge container toward the condensate housing. The overflow path may be disposed on at least one of a bucket side and a condensate housing side. The coupling of the bucket and the condensate housing by the overflow path may be released when the drawer is pulled out from the drawer space. The bucket and the condensate housing may be coupled by the overflow path when the drawer is received in the drawer space.

A latch may be disposed in at least one of the drawer-side structure and the cabinet-side structure. A hook may be disposed in another of the drawer-side structure and the cabinet-side structure. The state in which the drawer-side structure has been received in the drawer space may be maintained by mutual engagement of the latch and the hook.

DETAILED DESCRIPTION

Figure 1:
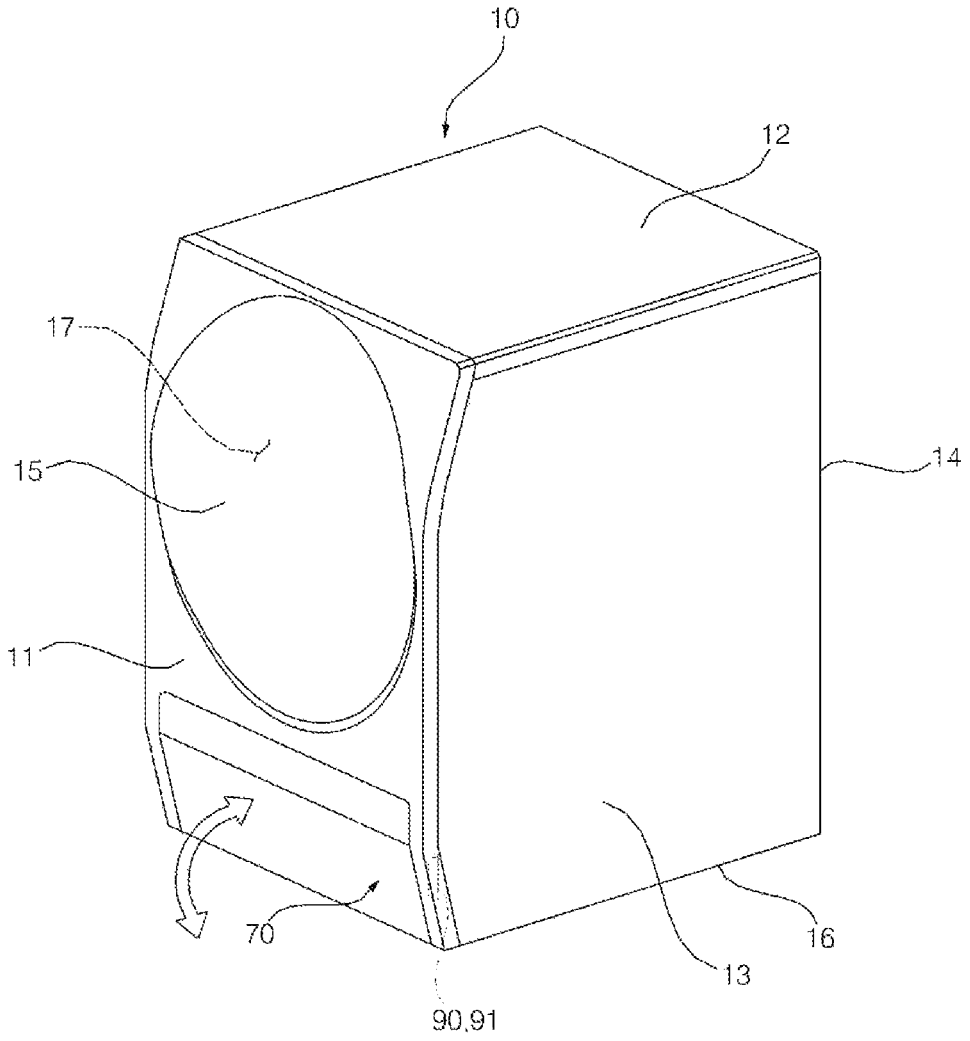
FIG. 1 is a perspective view of a dryer according to a first embodiment of the present invention.
Figure 2:
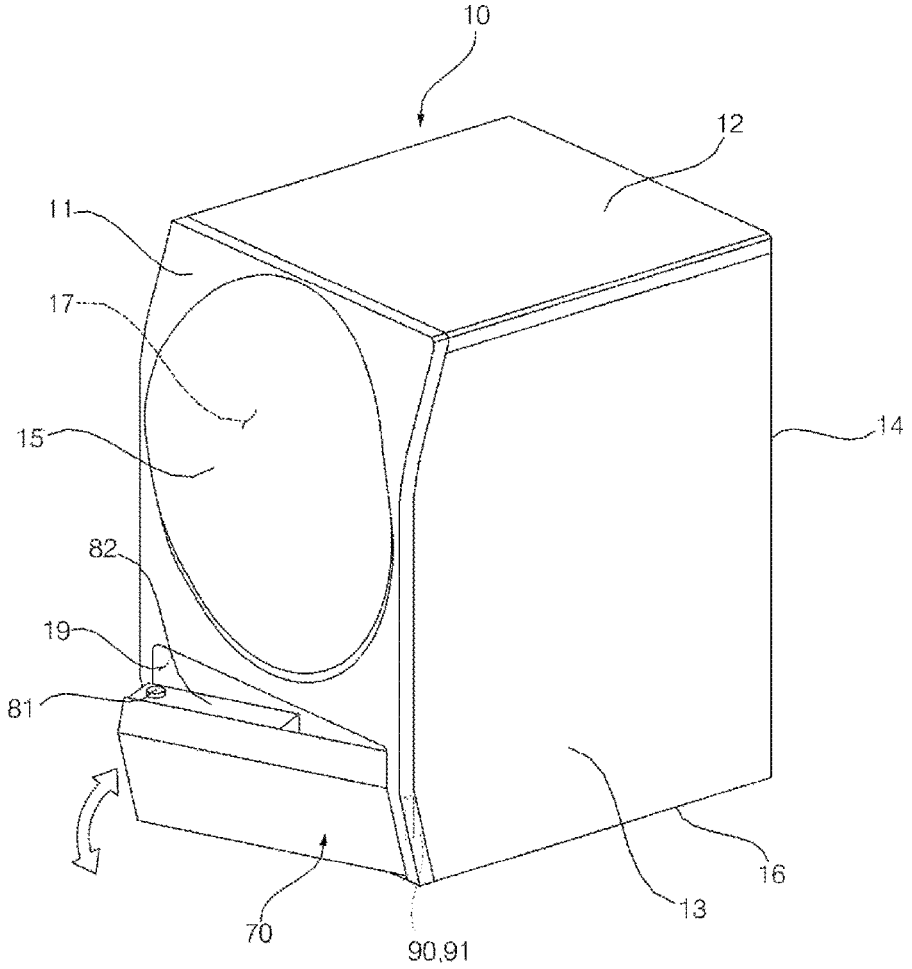
FIG. 2 is a perspective view showing the state in which a drawer assembly of FIG. 1 has been pulled out.
Figure 3:
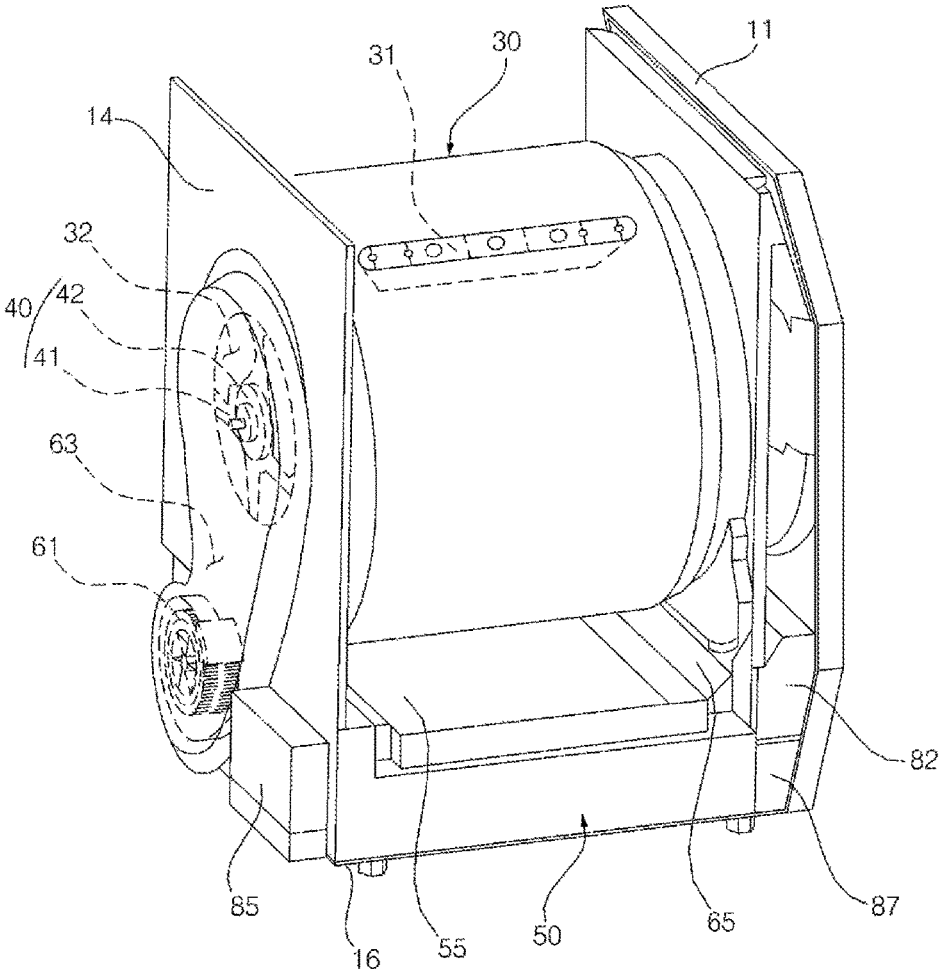
FIG. 3 is a perspective view showing the inside of the dryer of FIG. 1.
Figure 4:
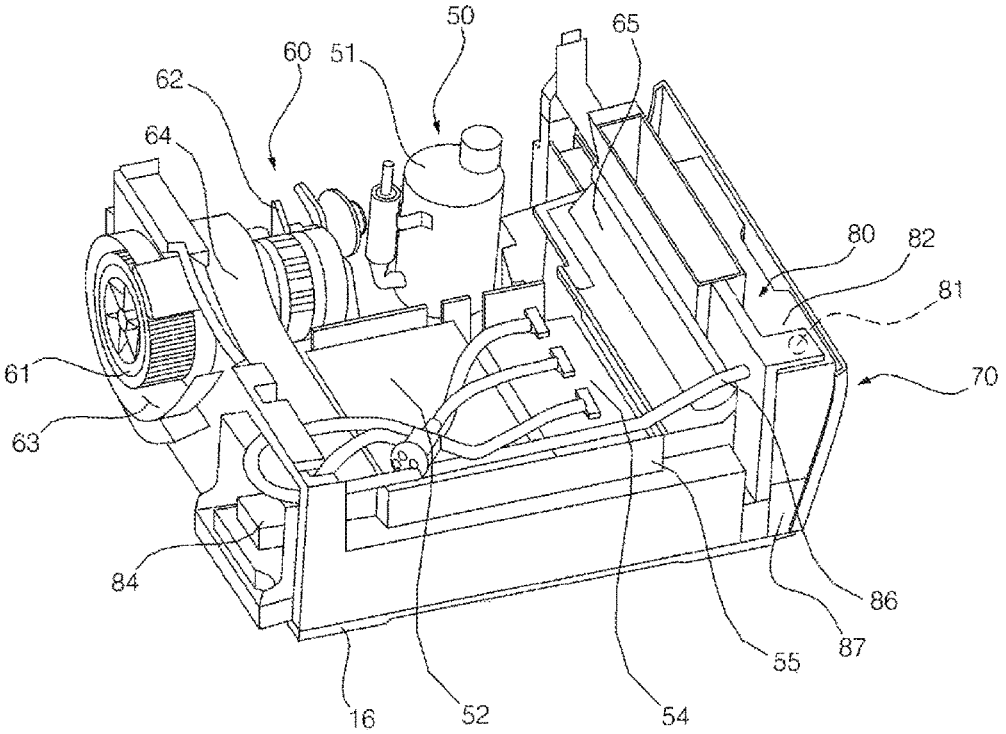
FIG. 4 is a perspective view showing the lower side under a drum of FIG. 3.
Figure 5:
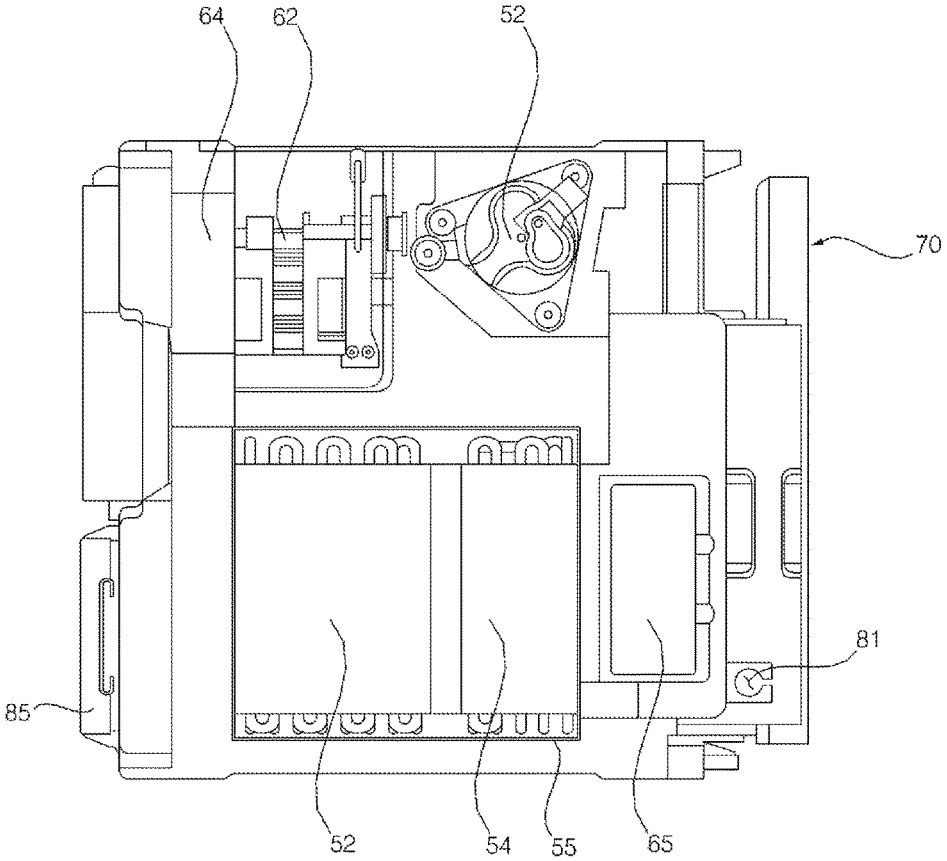
FIG. 5 is a plan view showing the lower side under the drum of FIG. 3.
Figure 6:
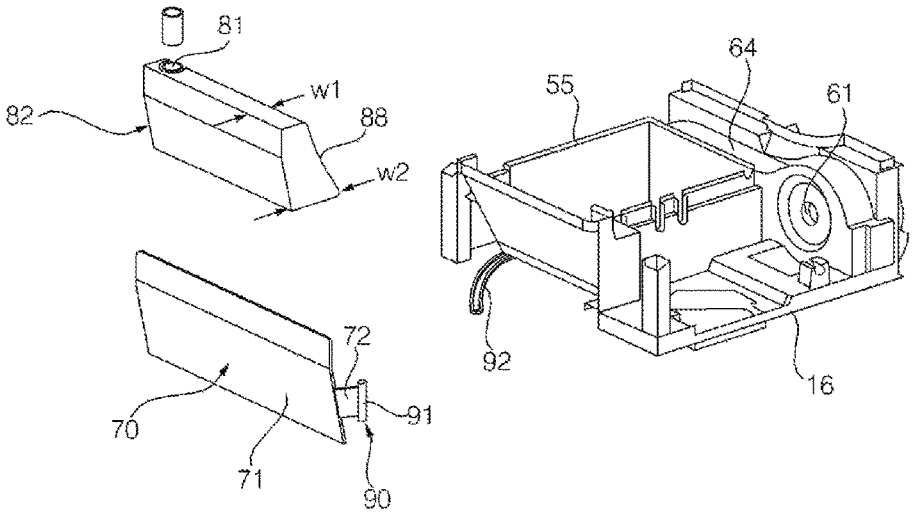
FIG. 6 is an exploded perspective view of the drawer assembly of FIG. 2.
Figure 7:
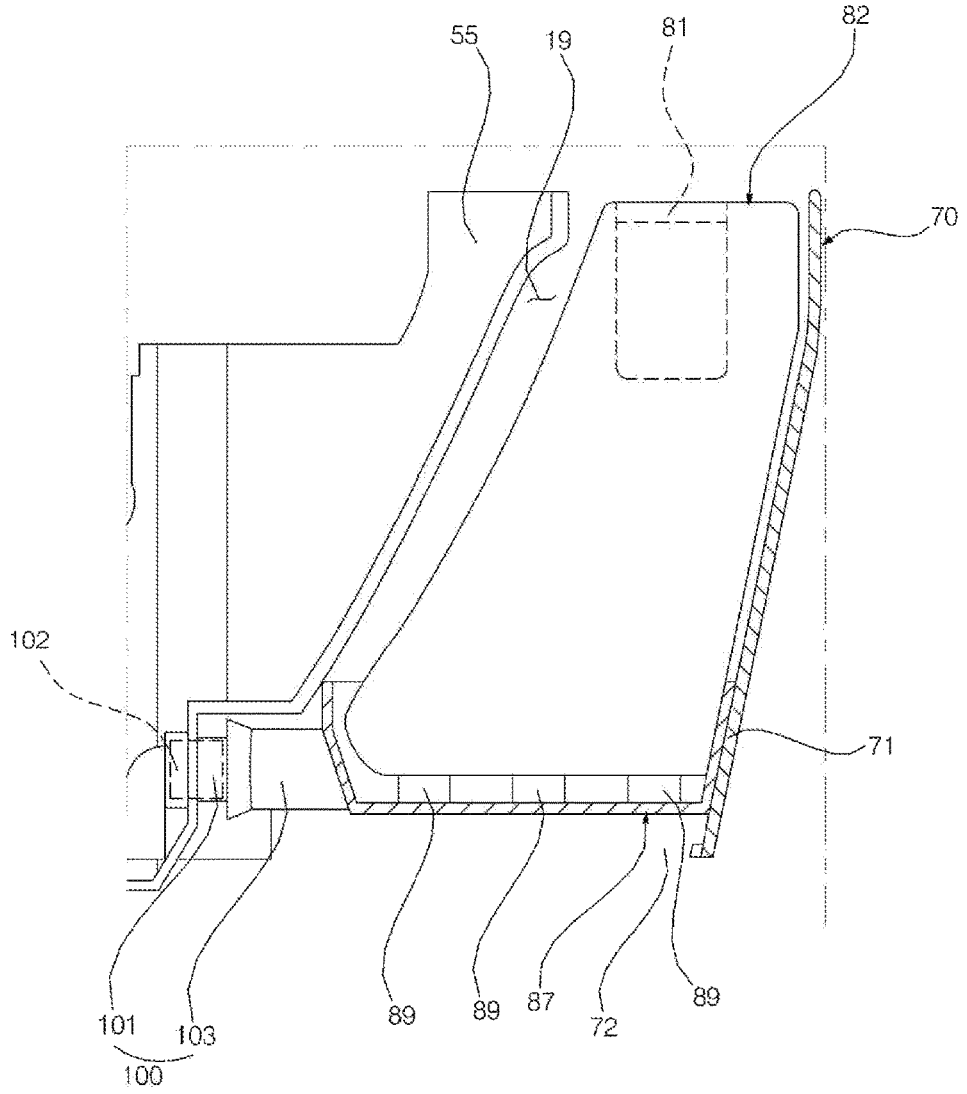
FIG. 7 is a cross-sectional view showing the state in which the condensate discharge container of FIG. 1 has been received.
Figure 8:
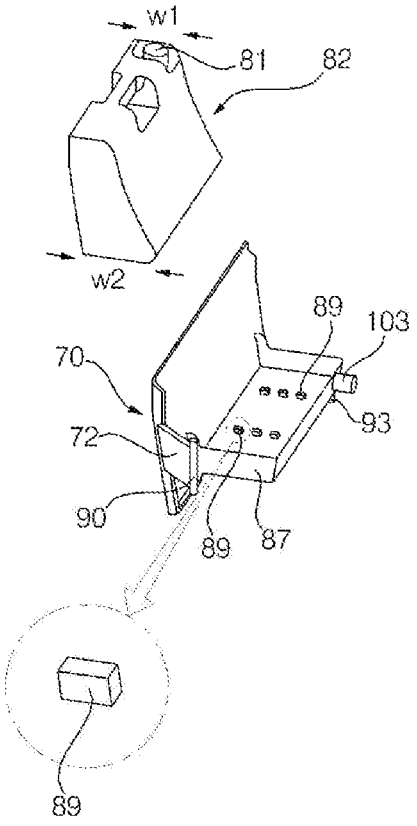
FIG. 8 is an exploded perspective view showing the back side of the drawer assembly of FIG. 6.

The below embodiments are merely provided to complete the disclosure of the present invention and to allow a person having ordinary skill in the art to which the present invention pertains to completely understand the category of the invention; they are not limiting. Embodiments of the present invention are defined by the category of the claims only. In the specification, the same reference numerals designate the same elements.

A dryer according to a first embodiment is described below with reference to FIGS. 1 to 8.

The dryer according to the first embodiment includes a cabinet 10 configured to form an external appearance, a drawer space 19 depressed backward from the front surface of cabinet 10, a drum 30 disposed within cabinet 10 which is configured to have the laundry received therein and rotated, a driving unit 40 configured to rotate drum 30, a heat pump unit 50 configured to dry the laundry by heating air circulating in the drum 30 and to remove moisture from the circulating air by condensing the moisture, an air circulation unit 60 configured to circulate the air of drum 30, a condensate storage module 80 disposed in cabinet 10 and configured to include a condensate discharge container 82 in which a condensate condensed by heat pump unit 50 is moved and stored, a drawer 70 disposed in the drawer space 19 and rotated forward from the cabinet 10, thereby exposing the condensate discharge container 82 to a user, and a support guide 90 disposed in the drawer 70 and the cabinet 10 and configured to guide the rotation of the drawer 70.

In the present embodiment, drawer 70 and condensate discharge container 82 are together pulled out forward from the cabinet 10.

Condensate discharge container 82 is hidden in drawer space 19 and is exposed out of the cabinet 10 when drawer 70 is pulled out.

Condensate discharge container 82 maintains the state in which it is hidden in the drawer space 19 until drawer 70 is pulled out. Drawer 70 is coupled to a guide supporter 90 and is pulled out forward from the cabinet 10 along the guide supporter 90.

Condensate discharge container 82 and drawer 70 are collectively defined as a drawer assembly.

Drawer space 19 in which the drawer assembly is received is formed in the cabinet 10. Drawer space 19 may be formed on the outside of cabinet 10. Drawer space 19 may be disposed under the drum 30. Drawer space 19 may be disposed under an entry hole 17 through which the laundry is inputted.

Cabinet 10 forms an external appearance of the dryer. Cabinet 10 has a door 15 disposed at its front. Door 15 is rotated left or right and opens/shuts the inside of the cabinet 10.

Cabinet 10 includes a front cover 11, a top plate 12, side covers 13, a rear cover 14, and a base 16. Door 15 is disposed in the front cover 11.

Entry hole 17 through which the laundry is inputted is formed in the front cover 11.

Drawer space 19 is placed on the lower side of the front cover 11. Drawer space 19 is depressed backward from the front cover 11.

When the drawer 70 is received in drawer space 19, it is flush with the front cover 11.

In other embodiments, drawer space 19 may be placed inside the front cover 11. That is, the drawer space 19 may be disposed in such a way as to be surrounded by the front cover 11.

Cabinet 10 may generally have a rectangular parallelepiped shape.

Door 15 is disposed on the front surface of cabinet 10 and operates so that it rotates left or right.

Entry hole 17 opened/shut by door 15 communicates with drum 30.

Drum 30 is disposed within the cabinet 10. In order to maximize the capacity of the drum 30, the condensate storage module 80 is disposed under the drum 30.

As such, the diameter of drum 30 within the cabinet 10 can be maximized because other operational parts are not disposed over the drum 30.

Drum 30 is formed in a cylindrical shape. Drum 30 has a lifter 31 disposed therein. Lifter 31 lifts up the laundry within the drum while rotating and then lets the laundry freely fall.

Driving unit 40 includes a driving motor 42 fixed to the cabinet 10. A driving shaft 41 of driving motor 42 is coupled to the back of the drum 30. Drum 30 may be rotated forward or backward by the rotation of the driving motor 42.

A circulation flow path along which air within the drum circulates is formed in the drum 30.

In the present embodiment, air has been illustrated as flowing from the back of the drum 30 to the inside of the drum, and air has been illustrated as being discharged to the front of the drum.

In some embodiments, the circulation flow path along which air within the drum circulates may be formed in various ways.

Air circulation unit 60 includes an impeller 61, an air circulation motor 62 configured to rotate the impeller 61, and the circulation flow path along which air discharged by the impeller 61 is guided In the present embodiment, impeller 61 is disposed inside the rear cover 14. More specifically, impeller 61 is disposed between the rear cover 14 and the drum 30.

Air circulation motor 62 is placed over the base 16 and placed under the drum 30. Air circulation motor 62 rotates the impeller 61. Impeller 61 is a kind of centrifugal ventilation fan for discharging air in a cylindrical direction.

In other embodiments, the circulation flow path may be configured in various ways.

In the present embodiment, the circulation flow path includes (i) a rear duct 63 configured to guide circulation air, discharged by the impeller 61, to the drum 30, (ii) a heat pump duct 64 configured to guide, circulation air supplied by the heat pump unit 50, to the impeller 61, and (iii) a drum duct 65 configured to guide, circulation air discharged by the drum 30, to the heat pump unit 50.

Rear duct 63 for guiding air discharged by the impeller 61 to the drum 30 is formed in the rear cover 14. The air guided to the drum 30 through the rear duct 63 flows into the drum 30 through the back of the drum 30.

To this end, a drum inlet 32 is formed at the back of the drum 30 so that air can flow into the drum 30.

Drum inlet 32 is disposed in the periphery of the driving shaft 41. Accordingly, when the drum 30 is rotated, circulation air discharged by the impeller 61 can flow into the drum through the drum inlet 32.

Heat pump duct 64 is disposed between the impeller 61 and the heat pump unit 50. Drum duct 65 is disposed between the drum 30 and the heat pump unit 50.

Heat pump unit 50 may drive a refrigerant in a heat pump cycle. Heat pump unit 50 may heat circulation air using heat generated from a condenser and may condense moisture within the circulation air using heat generated from an evaporator.

Heat pump unit 50 according to the present embodiment may implement heating and condensation with respect to circulation air.

In an alternative embodiment, only a condenser for condensing moisture within circulation air may be installed. The condenser operates as an evaporator and has the same function as a second heat exchanger 54 of the present embodiment. In this case, an external air and the circulation air are thermally exchanged in the condenser. The condensate of the circulation air is generated by the condenser through the thermal exchange. A mechanism and structure for generating the condensate through the condenser is known to those skilled in the art, and thus a detailed description thereof is omitted.

Heat pump unit 50 includes a compressor 51 configured to compress a refrigerant, a first heat exchanger 52 configured to condense the compressed refrigerant by thermally exchanging the compressed refrigerant and circulation air, an expansion valve (not shown) configured to expand the refrigerant condensed by the first heat exchanger 52, and the second heat exchanger 54 configured to evaporate the refrigerant expanded by the expansion valve by thermally exchanging the expanded refrigerant and the circulation air.

First heat exchanger 52 and second heat exchanger 54 are heat exchangers.

The expansion valve may be an electronic expansion valve.

First heat exchanger 52 is thermally exchanged with circulation air, and condenses a refrigerant. In the condensing process of the refrigerant, condensation heat of the refrigerant is discharged, and the discharged heat heats the circulation air.

The circulation air is heated by the condensation heat and used to dry the laundry.

Although not shown in the present embodiment, a heater (not shown) may be disposed in the circulation flow path, and the circulation air may be heated to a higher temperature using heat generated by the heater.

Second heat exchanger 54 is thermally exchanged with circulation air, and evaporates a refrigerant. In the evaporation process of the refrigerant, the refrigerant absorbs evaporation heat, and the circulation air is cooled by the evaporation heat. When the circulation air is cooled, moisture within the circulation air may be condensed, thereby being capable of generating a condensate. The moisture within the circulation air may include wash water evaporated from the laundry.

In the present embodiment, first heat exchanger 52 and second heat exchanger 54 are disposed over the base 16 in a line. A condensate housing 55 in which the first heat exchanger 52 and the second heat exchanger 54 are received is disposed over the base 16. Second heat exchanger 54 and the condenser are disposed in a line within the condensate housing 55.

The condensate of the circulation air is stored in the condensate housing 55 disposed within the cabinet 10 and is then moved to the condensate discharge container 82 by a condensate pump 84.

That is, the dryer according to the present embodiment generates a condensate within the cabinet 10, moves the condensate to the condensate discharge container 82 outside the cabinet 10, and stores the condensate in the condensate discharge container 82.

Circulation air discharged by drum 30 is supplied to the condensate housing 55 via the drum duct 65. The circulation air is thermally exchanged with the second heat exchanger 54 within the condensate housing 55 and then thermally exchanged with the first heat exchanger 52.

Second heat exchanger 54 is thermally exchanged with circulation air discharged by the drum 30, and condensates moisture included in the circulation air. The condensate flows downward by its own weight and collects at the condensate housing 55.

Condensate housing 55 has its bottom backward inclined.

Condensate pump 84 is disposed at the rear of the condensate housing 55. The condensate pump 84 pumps the collected condensate toward the condensate discharge container 82.

In the present embodiment, the circulation air flows from the front of the condensate housing 55 to the back because the drum duct 65 is disposed at the front of the condensate housing 55. The condensate may naturally flow toward the back of the condensate housing 55 by the inclined direction and the circulation air.

The circulation air that is thermally exchanged with the second heat exchanger 54 and cooled is thermally exchanged with the first heat exchanger 52 disposed at the back of the second heat exchanger 54. First heat exchanger 52 heats the circulation air. The circulation air heated by the first heat exchanger 52 flows into the impeller 61 through the heat pump duct 64.

Condensate storage module 80 stores the condensate, collected at the condensate housing 55, in the condensate discharge container 82.

A user may separate the condensate discharge container 82 in which the condensate has been stored from the cabinet 10 and discard the condensate stored in the condensate discharge container 82.

Condensate storage module 80 includes the condensate discharge container 82 detachably disposed in the cabinet 10, the condensate pump 84 disposed in the cabinet 10 and configured to move a condensate, collected at the condensate housing 55, toward the condensate discharge container 82, and a condensation discharge hose 86 configured to guide the condensate, discharged by the condensate pump 84, to the condensate discharge container 82.

Condensate discharge container 82 is a space in which a condensate generated from the second heat exchanger 54 is stored. Condensate discharge container 82 may be separately disposed outside the cabinet 10.

A condensate is also stored in the condensate housing 55, but the condensate discharge container 82 is an element different from the condensate housing 55. Condensate housing 55 is used to collect a condensate until at least a specific amount of the condensate is reached. Condensate discharge container 82 is a space for storing a condensate pumped by the condensate housing 55.

Operation frequency of the condensate pump 84 can be reduced only when at least a specific amount of a condensate is pumped.

Condensate discharge container 82 is placed on the lower front side of the cabinet 10 and covered with the drawer 70.

In the present embodiment, drawer 70 forms a face flush with the front cover 11. Drawer 70 covers the entire condensate discharge container 82. In some embodiments, the drawer 70 may cover only part of the condensate discharge container 82 or may not cover the condensate discharge container 82 at all.

Drawer 70 is disposed in drawer space 19. Drawer 70 covers the drawer space 19. In the present embodiment, condensate discharge container 82 may be held in the drawer 70 and pulled out forward from the cabinet 10 along with the drawer 70.

Drawer 70 includes a drawer cover 71 configured to cover at least part of the condensate discharge container 82, a bucket 87 disposed on the back surface of the drawer cover 71 and configured to have the condensate discharge container 82 held therein, and a drawer holder 72 disposed in the drawer cover 71 and connected to the cabinet 10.

In some embodiments, drawer holder 72 may be omitted. If drawer holder 72 is omitted, the cabinet 10 and the drawer cover 71 are connected. Drawer holder 72 may be integrated with the drawer cover 71.

The support guide 90 is disposed in the drawer holder 72, and the drawer assembly is coupled to the cabinet 10 by the guide supporter 90.

Condensate discharge container 82 is supplied with a condensate through the condensation discharge hose 86, and stores the supplied condensate.

Condensate discharge container 82 is detachably disposed in the cabinet 10. Condensate discharge container 82 is disposed in the drawer space 19 and is pulled out forward from the drawer space 19 along with the drawer 70.

Condensate discharge container 82 is lengthily extended in the width direction of the cabinet 10. That is, condensate discharge container 82 may have a length longer in the width direction than in the front and back direction. Further, condensate discharge container 82 may have a length longer in the up and down direction than in the front and back direction.

Condensate discharge container 82 formed in the width direction minimizes an insertion depth into the cabinet 10. The length in which the condensate discharge container 82 is pulled out can be minimized because the depth inserted into the cabinet 10 is minimized. That is, a space required to pull out the condensate discharge container 82 is minimized because the length in the front and back direction of the condensate discharge container 82 is minimized.

When the condensate discharge container 82 is pulled out, a drawer space corresponding to at least a length in the front and back direction of the condensate discharge container 82 is required. In the present embodiment, such a drawer space can be minimized.

For example, there is no problem in pulling out the condensate discharge container 82 if there is a space to the extent that the door 15 can be open. Although the radius of the door 15 is small, the condensate discharge container 82 can be pulled out.

Condensate discharge container 82 is disposed at the front of the condensate housing 55. Condensate discharge container 82 is disposed between the drawer 70 and the condensate housing 55. Condensate discharge container 82 is disposed on the lower front side of the drum 30.

Drum duct 65 is disposed on the lower front side of the drum 30. Drum duct 65 is disposed between the condensate housing 55 and the condensate discharge container 82.

Condensate discharge container 82 is disposed under the door 15. Condensate discharge container 82 is disposed over the base 16.

Condensate discharge container 82 has a length longer in the left and right width than in the front and back direction. There is an advantage in that the length in which the condensate discharge container 82 is pulled out can be minimized because the length of the condensate discharge container 82 is shorter in the front and back direction than in the left and right width as described above.

A condensate hole 81 is disposed on top of the condensate discharge container 82. The condensate of the condensate housing 55 is supplied through condensate hole 81.

Condensate discharge container 82 and the condensation discharge hose 86 may be directly coupled. In the present embodiment, a condensate dropping from the condensation discharge hose 86 flows into the condensate discharge container 82 through the condensate hole 81.

The attachment/detachment structure of the condensate discharge container 82 can be implemented simply due to the structure in which a condensate drops.

Furthermore, a front and back direction length w1 on the top surface of the condensate discharge container 82 is smaller than a front and back direction length w2 on the bottom thereof. Accordingly, the condensate discharge container 82 has a cross section that becomes wider from the top to the bottom.

There is an advantage in that a user can lift up the condensate discharge container 82 more easily because the top of the condensate discharge container 82 is narrower. That is, a user can grasp the condensate discharge container 82 easily because the condensate discharge container 82 is short in the front and back direction and long in the width direction.

In the present embodiment, an incline plane 88 is formed on the back surface of the condensate discharge container 82 due to the difference between the front and back direction lengths w1 and w2. Condensate discharge container 82 may have a trapezoid shape. In the present embodiment, however, the condensate discharge container 82 may have a generally vertical front surface and an inclined back surface.

Such a shape has been made by taking into consideration an angle when a user lifts up the condensate discharge container 82. A user tends to lift up the condensate discharge container 82 while pulling it toward his or her side rather than to vertically lift up the condensate discharge container 82. Incline plane 88 on the back surface of the condensate discharge container 82 has been made by taking into consideration such a use pattern.

There is an advantage in that the incline plane 88 can minimize interference with other elements of the cabinet 10 when a user lifts up the condensate discharge container 82.

Furthermore, the bottom of condensate discharge container 82 is wider than the top thereof. Accordingly, condensate discharge container 82 does not fall although stored condensate moves around, and thus the condensate can be safely held in the condensate discharge container 82.

The front surface of condensate housing 55 is inclined in accordance with the incline plane 88 of the condensate discharge container 82. Accordingly, the upper front side of the condensate housing 55 is forward protruded, and the lower front side thereof is backward recessed.

The shaking of condensate discharge container 82 can be minimized because the front surface of the condensate housing 55 and the back surface of the condensate discharge container 82 are matched in shape and closely attached, and thus vibration can be suppressed when the drum 30 operates.

Furthermore, the center of gravity of the dryer can move downward because the condensate discharge container 82 is disposed under the drum 30. That is, the center of gravity of the dryer further moves downward as a condensate is stored in the condensate discharge container 82. Accordingly, stability can be improved when the drum 30 operates as the center of gravity of the dryer moves downward.

Furthermore, since condensate discharge container 82 is disposed at the front of the drum 30, a variation in weight can be reduced in accordance with the driving unit 40. That is, weight of the dryer can be distributed in the front and back direction because the driving unit 40 is disposed on the back side of the drum 30 and the condensate discharge container 82 is disposed on the front side of the drum 30 based on the front and back direction of the dryer.

As described above, the location of condensate discharge container 82 has an advantage in that vibration generated when the dryer operates can be reduced.

Condensate pump 84 is disposed at the back of the condensate housing 55.

Condensation discharge hose 86 has one end coupled to the condensate pump 84 and has the other end coupled to the condensate hole 81.

Condensate pump 84 may be disposed inside the rear cover 14. In the present embodiment, a pump cover 85 is separately provided. Pump cover 85 is assembled with the rear cover 14, thus hiding pump 84. When pump 84 fails or is checked, pump cover 85 may be separated so that the condensate pump 84 is exposed.

Drawer 70 includes bucket 87 configured to receive a condensate overflowed from the condensate discharge container 82. Bucket 87 is disposed on the back surface of the drawer 70. Bucket 87 is integrated with the drawer 70. In some embodiments, bucket 87 may be fabricated separately from the drawer 70 and then fixed to the drawer 70.

Condensate discharge container 82 may be separated upward from the bucket 87. Condensate discharge container 82 is held inside the bucket 87.

Bucket 87 may receive at least part of the condensate discharge container 82. In the present embodiment, bucket 87 is disposed under the condensate discharge container 82, and part of the lower side of the condensate discharge container 82 is inserted into the bucket 87.

Bucket 87 stores a condensate overflowed from the condensate hole 81. Bucket 87 further includes a support rib 89 configured to support the condensate discharge container 82.

Support rib 89 is formed on the inside surface of the bucket 87. Condensate discharge container 82 is held in the support rib 89. Condensate discharge container 82 is spaced apart by the height of the support rib 89. Accordingly, a condensate overflowed from the periphery of the support rib 89 can be received.

The overflowed condensate may flow into the condensate housing 55. To this end, an overflow path 100 for coupling the bucket 87 and the condensate housing 55 is installed.

A check valve 102 is installed on the overflow path 100. Check valve 102 allows a condensate to flow only from the bucket 87 to the condensate housing 55, but prevents a condensate from flowing in the opposite direction. Specifically, check valve 102 may prevent the wet steam of the condensate housing 55 from moving into the bucket 87.

Overflow path 100 may be fabricated as a single part. In the present embodiment, overflow path 100 includes a first overflow joint pipe 101 coupled to the condensate housing 55 and a second overflow joint pipe 103 coupled to the bucket 87.

Check valve 102 is installed on the first overflow joint pipe 101. In some embodiments, check valve 102 may be installed on the second overflow joint pipe 103.

First overflow joint pipe 101 and second overflow joint pipe 103 may be coupled or separated.

When drawer 70 is received in the drawer space 19, first overflow joint pipe 101 and second overflow joint pipe 103 are coupled. When the drawer 70 is pulled out from the drawer space 19, the first overflow joint pipe 101 and the second overflow joint pipe 103 are separated. Although the second overflow joint pipe 103 is separated from the first overflow joint pipe 101, a fluid within the condensate housing 55 is prevented from flowing outward by the check valve 102.

If overflow path 100 is formed of a single part, it may be disposed on at least one side of the bucket and the condensate housing. If overflow path 100 is formed of a single part, when drawer 70 is pulled out from the drawer space 19, the connection of the bucket 82 and the condensate housing 55 by the overflow path 100 is released. If overflow path 100 is formed of a single part, when the drawer 70 is received in the drawer space 19, the bucket 82 and the condensate housing 55 are coupled by the overflow path 100.

Drawer 70 is disposed at the front of the condensate discharge container 82.

In the present embodiment, the entire condensate discharge container 82 has been illustrated as being covered with the drawer 70. In an alternative embodiment, only part of the condensate discharge container 82 may be covered with the drawer 70.

Drawer 70 may be forward rotated and pulled out by a user's manipulation force. When drawer 70 is rotated and pulled out, condensate discharge container 82 is also pulled out forward. Condensate discharge container 82 is moved forward and exposed to a user.

Drawer 70 forms the front surface of the dryer along with the front cover 11.

Drawer 70 is disposed on the lower side of the front cover 11.

In the present embodiment, guide supporter 90 is disposed in order to pull out the drawer 70 forward by guiding the rotation of the drawer 70. Guide supporter 90 couples the drawer assembly and a cabinet-side structure and guides the rotation of the drawer assembly.

A drawer-side structure may be the drawer 70, the bucket 87, or the drawer holder 72. The cabinet-side structure may be the front cover 11, the base 16, or the condensate housing 55.

In the present embodiment, the drawer assembly is supported by the guide supporter 90, and guides the rotation of the guide supporter 90. The drawer assembly is rotated around an axis disposed on one side thereof.

In the present embodiment, guide supporter 90 is horizontally rotated.

Guide supporter 90 includes a pivot 91 disposed on one side of the drawer 70 and configured to form the rotating center of the drawer assembly and a rotation guide 92 disposed on the other side of the drawer 70 and configured to guide the rotation of the drawer.

Guide supporter 90 supports a load of the drawer assembly including the bucket 87 and guides the rotation of the drawer assembly.

Pivot 91 is installed on the drawer holder 72. Unlike in the present embodiment, the pivot 91 may be installed on the bucket 87.

Rotation guide 92 is disposed on the side opposite the side of the drawer holder 72 based on the drawer 70. Rotation guide 92 is formed to have an arc shape.

Rotation guide 92 may be fixed to the base 16 or the condensate housing 55. Rotation guide 92 may be disposed under the bucket 87.

Drawer 70 is held or coupled to the rotation guide 92. A guide protrusion 93 is disposed in the drawer 70. Guide protrusion 93 may move along the rotation guide 92. Guide protrusion 93 may be disposed under the bucket 87.

Pivot 91 supports a load of the drawer assembly on one side thereof, and the rotation guide 92 supports a load of the drawer assembly on the other side thereof.

The drawer assembly can be prevented from leaning toward any one side by the support of the pivot 91 and the rotation guide 92. Accordingly, the rotation operation of the drawer assembly can be smoothly implemented.

Furthermore, when the drawer assembly is received in drawer space 19, an optional latching unit for confining the drawer assembly to the drawer space may be further installed. The optional latching unit may be a latch. The latch may be installed on any one of the drawer-side structure and the cabinet-side structure and may form mutual engagement along with the other side.

Furthermore, a drawer elastic member (not shown) may be disposed between the drawer assembly and the cabinet 10. When the latching of the latch is released, the drawer elastic member functions to push the drawer space 19 to the outside by applying an elastic force to the drawer assembly. When the drawer assembly is received in the drawer space 19, the drawer elastic member is compressed and accumulates an elastic force.

The drawer-side structure may be the drawer 70, the bucket 87, or the drawer holder 72. The cabinet-side structure may be the front cover 11, the base 16, or the condensate housing 55.

When a user backward presses the drawer 70, the latching of the latch may be released. When the latch is released, a drawer elastic member (not shown) for moving the drawer 70 by pushing it forward may be further disposed.

The drawer elastic member is disposed between the cabinet-side structure and the drawer assembly-side structure, and may provide an elastic force.

For example, the drawer elastic member may be installed on at least any one of the condensate housing 55, that is, a cabinet-side structure, and the guide supporter 90, that is, a drawer-side structure, and provide a forward elastic force.

For example, the drawer elastic member may be installed in the latch and may provide an elastic force.

When drawer 70 is pulled out, a user releases the latch by pushing the drawer 70 backward (i.e., "in"). Drawer 70 is forward pushed (i.e., "in") and moved by the elastic force of the drawer elastic member.

When drawer 70 is received in the cabinet 10, a user closely attaches the drawer 70 to the back, and thus the drawer 70 is engaged with the latch 95.

The latching of the latch or the release of the latching is known to those skilled in the art, and thus a detailed description thereof is omitted.

Furthermore, when such mutual engagement is formed by the latch 95, the first overflow pipe 101 and the second overflow pipe 103 are coupled. The coupling of the first overflow pipe 101 and the second overflow pipe 103 is maintained by the latch.

When the latching of the latch 95 is released, however, the first overflow pipe 101 and the second overflow pipe 103 are separated.

Guide supporter 90 and latch 95 function to reliably form the overflow path 100, and prevent the condensate of the bucket 87 from leaking.

Figure 9:
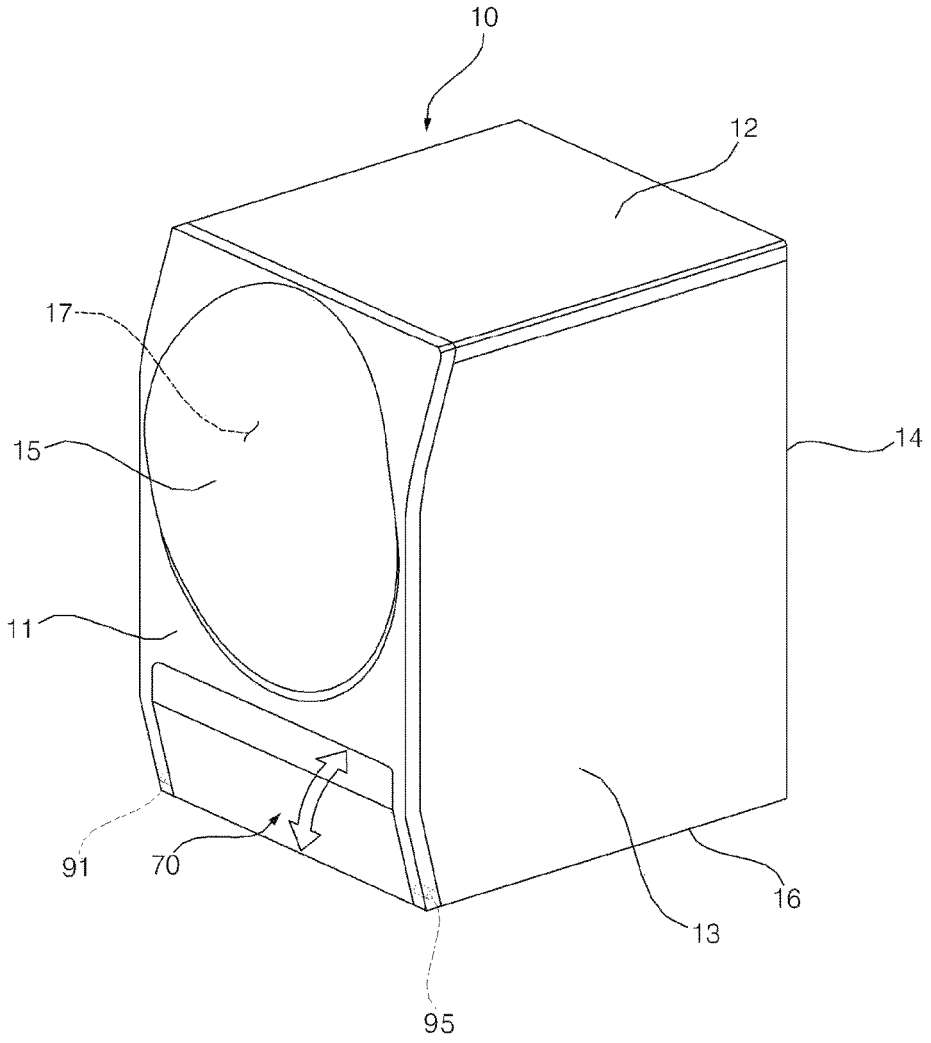
FIG. 9 is a perspective view of a dryer according to a second embodiment of the present invention.
Figure 10:
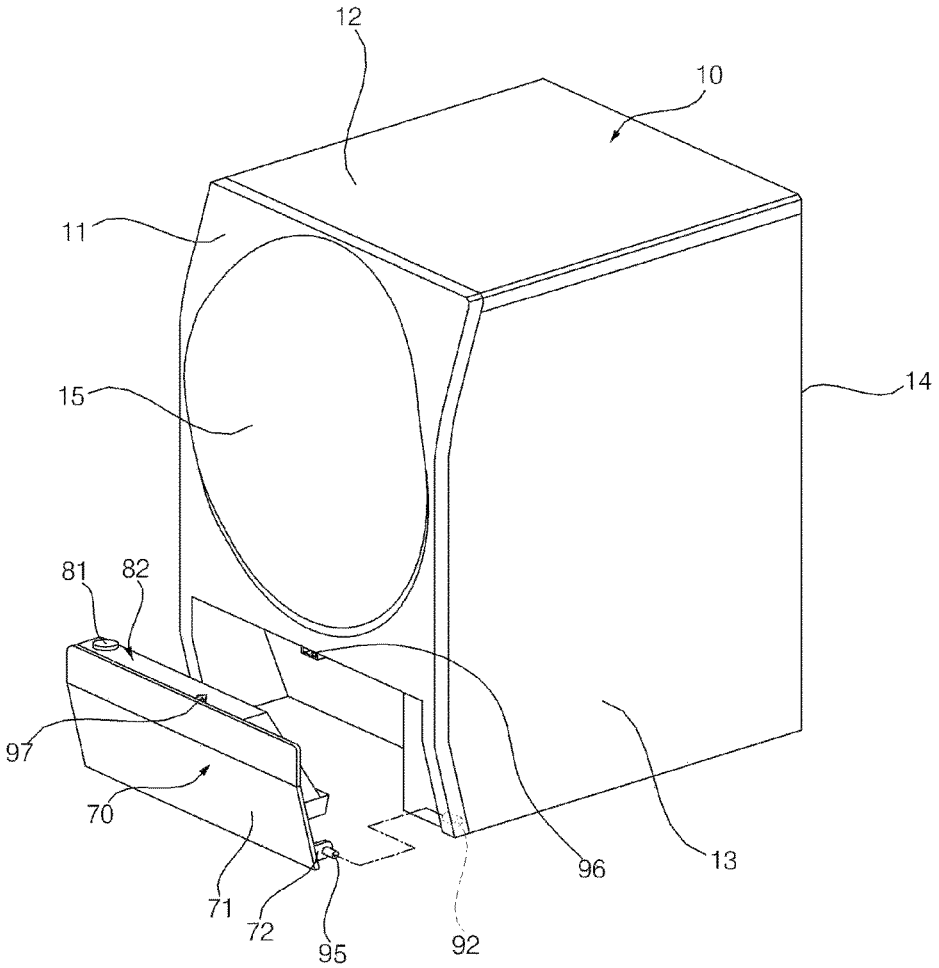
FIG. 10 is a perspective view showing the state in which a drawer assembly of FIG. 9 has been pulled out.

A dryer according to a second embodiment is described below with reference to FIG. 9 or 10.

In the dryer according to the second embodiment, the drawer assembly is rotated and pulled out forward from the drawer space 19, but it is rotated up and down.

To this end, pivots 95 of the guide supporter 90 may be disposed in a left and right direction or horizontal direction with respect to the cabinet 10.

Pivots 95 are installed on the left and right sides of the drawer 70.

Pivots 95 are protruded from the drawer holder 72 of the drawer 70 to the left side and the right side, respectively.

Pivots 95 are horizontally disposed, and thus the drawer assembly may be rotated up and down around the pivots 95.

The rotation of the drawer assembly can be implemented easily by the self-weight of the condensate discharge container 82.

In order to confine the drawer assembly to the drawer space 19, a latch 96 may be installed on the cabinet-side structure, and a hook 97 may be installed on the drawer assembly-side structure.

In the second embodiment, the latch 96 is disposed in the front cover 11, and the hook 97 is disposed in the drawer 70.

Hook 97 may optionally form mutual engagement with the latch 96.

Upon the mutual engagement, the drawer assembly is received in the drawer space 19.

The remaining elements are the same as those of the first embodiment, and thus a detailed description thereof is omitted.

The dryer according to an embodiment of the present invention has the following one or more effects.

First, there is an advantage in that a space required to pull out the condensate discharge container can be minimized because the condensate discharge container is laterally disposed.

Second, there is an advantage in that a drum having a higher capacity compared to the same size can be installed because a structure disposed over the drum within the cabinet is minimized and the condensate discharge container is disposed on the lower side of the drum, which has a relatively larger margin.

Third, there is an advantage in that the center of gravity is further lowered by a condensate generated in a dryer operation process because the condensate discharge container is disposed under the drum.

Fourth, there is an advantage in that only the condensate discharge container can be separated by lifting up the condensate discharge container exposed to a user after the drawer is pulled out.

Fifth, there is an advantage in that load imbalance in the front and back direction of the dryer can be minimized when a condensate is filled because the condensate discharge container is disposed at the front of the drum.

Sixth, there is an advantage in that the condensate discharge container is moved to the position where a user can grasp the condensate discharge container easily because the condensate discharge container is also rotated and pulled out when the drawer is rotated and pulled out.

Seventh, there is an advantage in that a load of the drawer can be reduced because the condensate discharge container remains in the drawer space and only the drawer is pulled out when the drawer is rotated and pulled out.

Eighth, there is an advantage in that the drawer assembly can be rotated and the condensate discharge container can be pulled out if there is a space to the extent that the door is open.

Those skilled in the art to which the present invention pertains will appreciate that the present invention may be implemented in other detailed forms without departing from the technical spirit or essential characteristics of the present invention. Accordingly, the aforementioned embodiments should be understood as being only illustrative, but should not be understood as being restrictive from all aspects. The scope of the present invention is defined by the following claims rather than the detailed description, and the meanings and scope of the claims and all changes or modified forms derived from their equivalents should be construed as falling within the scope of the present invention.

What is claimed is:

1. A dryer, comprising:

a cabinet with an entry hole formed on a front surface thereof;

a driving motor disposed to the cabinet;

a door installed in the entry hole;

a drum disposed within the cabinet and rotatable by the driving motor, the drum holding received laundry;

an evaporator disposed within the cabinet to remove moisture from air circulating through the drum by condensing the moisture;

a condensate housing disposed within the cabinet a condensate water condensed by the evaporator being collected at the condensate housing;

a drawer space disposed under the entry hole and depressed backward from the front surface of the cabinet;

a drawer disposed in the drawer space to be rotated based on a first side of the drawer and pulled out from the drawer space, the drawer being disposed separately from the cabinet;

a condensate discharge container to store the condensate moved from the condensate housing, the condensate discharge container detachably held in the drawer, and exposed to a user when the drawer is pulled out; and a guide supporter to couple a cabinet-side structure and a drawer-side structure and to guide the rotation of the drawer with respect to the cabinet, wherein the evaporator is disposed within the condensate housing, wherein the condensate housing is disposed at a back of the condensate discharge container, and wherein the condensate discharge container has a length longer in a left and right width direction than in a front and back direction.

2. The dryer of claim 1, wherein when the drawer is pulled out, the drawer is pulled out from the drawer space along with the condensate discharge container.

3. The dryer of claim 1, wherein when the drawer is pulled out, the drawer is pulled out from the drawer space and the condensate discharge container remains in the drawer space.

4. The dryer of claim 1, wherein the drawer is installed in a horizontal direction in such a way as to be rotated around the cabinet, and wherein the guide supporter comprises a pivot disposed on the first side of the drawer to form a vertical rotating center of the drawer.

5. The dryer of claim 4, wherein the guide supporter further comprises a rotation guide disposed on a second side of the drawer to guide the rotation of the drawer.

6. The dryer of claim 5, wherein the rotation guide couples the drawer and the cabinet.

7. The dryer of claim 5, wherein the rotation guide couples the drawer and the condensate housing.

8. The dryer of claim 1, wherein the drawer is installed in such a way as to be rotated around the cabinet, and the guide supporter comprises pivots disposed on both sides of the drawer to form a horizontal rotating center of the drawer.

9. The dryer of claim 1, wherein the drawer comprises a bucket to store overflow condensate from the condensate discharge container.

10. The dryer of claim 9, wherein the drawer is installed in a horizontal direction in such a way as to be rotated around the cabinet, and wherein the guide supporter comprises a pivot disposed on a first side of the bucket to form a vertical rotation center of the drawer.

11. The dryer of claim 10, wherein the guide supporter further comprises a rotation guide disposed on a second side of the drawer to guide the rotation of the drawer.

12. The dryer of claim 9, wherein the drawer is installed in a horizontal direction in such a way as to be rotated around the cabinet, and wherein the guide supporter comprises pivots disposed on both sides of the bucket to form a horizontal rotation center of the drawer.

13. The dryer of claim 9, further comprising:

an overflow path disposed between the bucket and the condensate housing to recover overflow condensate from the condensate discharge container toward the condensate housing, wherein the overflow path is disposed on at least one of a bucket side and a condensate housing side, wherein a coupling of the bucket and the condensate housing by the overflow path is released when the drawer is pulled out from the drawer space, and wherein the bucket and the condensate housing are coupled by the overflow path when the drawer is received in the drawer space.

14. The dryer of claim 1, wherein a latch is disposed in at least one of the drawer-side structure and the cabinet-side structure, wherein a hook is disposed in another of the drawer-side structure and the cabinet-side structure, and wherein a state in which the drawer-side structure has been received in the drawer space is maintained by mutual engagement of the latch and the hook.

* * * * *